US006039441A

United States Patent [19]

Tomikawa et al.

[11] Patent Number: 6,039,441

[45] Date of Patent: Mar. 21, 2000

[54] INK JET RECORDING UNIT

[75] Inventors: Ichiro Tomikawa; Mitsuhide Soga; Katsuyuki Fujii; Katsuhide Ogawa; Junichi Yoshida, all of Ebina; Shigeo Kawachi; Takehiko Noda, both of Yao, all of Japan

[73] Assignee: Fuji Xerox Co., Ltd., Tokyo, Japan

[21] Appl. No.: 08/720,149

[22] Filed: Sep. 25, 1996

[30] Foreign Application Priority Data

Sep. 28, 1995 [JP] Japan ..... 7-250811
Sep. 28, 1995 [JP] Japan ..... 7-250812

[51] Int. Cl.[7] ..... B41J 2/175

[52] U.S. Cl. ..... 347/86

[58] Field of Search ..... 347/84, 85, 86, 347/87; 277/607, 630, 644, 645

[56] References Cited

U.S. PATENT DOCUMENTS

| | | | |
|---|---|---|---|
| 4,757,331 | 7/1988 | Mizusawa | 347/85 |
| 5,359,357 | 10/1994 | Takagi et al. | 347/49 |
| 5,540,450 | 7/1996 | Hayashi et al. | 277/607 |
| 5,583,549 | 12/1996 | Ujita et al. | 347/86 |

FOREIGN PATENT DOCUMENTS

| | | |
|---|---|---|
| 6-210869 | 8/1994 | Japan . |
| 07054835 | 2/1995 | Japan . |
| 0 666 176 A2 | 8/1995 | Japan . |
| 8-156279 | 6/1996 | Japan . |

*Primary Examiner*—N. Le
*Assistant Examiner*—Michael Nghiem
*Attorney, Agent, or Firm*—Oliff & Berridge, PLC

[57] ABSTRACT

An elastic jointing member 22 with an umbrella-like portion with an opening and a flat part is provided in a jointing portion between a recording head 21 and an ink tank 1. When the ink tank 1 is attached to the recording head 21, the umbrella-like portion of the elastic jointing member 22 is pressed against the ink tank and elastically deformed inward. As a result, an ink passage is formed which is airtightly sealed. In the process of pressing the umbrella-like portion against the ink tank, the umbrella-like portion comes in contact with the flat part, to thereby prevent air from staying in the ink passage. Protrusions or grooves may be provided between the umbrella-like portion and the flat part. With the protrusions or the groove, the umbrella-like portion is not glued to the flat part.

6 Claims, 9 Drawing Sheets

INK JET RECORDING UNIT

BACKGROUND OF THE INVENTION

The present invention relates to an ink jet recording unit for recording by ejecting ink. More particularly, the invention relates to an ink jet recording unit which is formed with a recording head and an ink tank removably mounted to the recording head.

Recently, the ink jet recording device increases the range of its use. A number of ink jet recording units of the type which is formed with a recording head and an ink tank removably attached to the recording head are marketed.

In this type of the ink jet recording unit, when the ink tank is set to the recording head, it is necessary to hermetically seal a passage for ink flowing from the ink tank to the recording head, which is located in the jointing portion between the ink tank and the recording head. If the sealing of the ink passage is incomplete, ink leaks outside to give great nuisance to users. Particularly, to the ink tank which uses a portion containing only ink, not the capillary member, the complete sealing of that ink passage is essential.

In many ink jet recording units having the ink tank and the recording head, an O ring is used for hermetically sealing the ink passage for the ink flow from the ink tank to the recording head. An example of the ink jet recording unit using the O ring is disclosed in Unexamined Japanese Patent Publication 6-210869. In the publication, the ink tank is provided with a valve, and an O ring, removably mounted, is used for hermetically sealing the ink passage for the ink flow from the ink tank to the recording head.

The ink jet recording unit using the O ring for hermetically sealing the ink passage has the following problems. To airtightly seal the ink passage in the jointing portion between the ink tank and the recording head, a high pressing force is required. Accordingly, a strong force must be used for detaching the ink tank from the recording head. This impairs an easy handling of the ink jet recording unit. Additionally, a structure for generating the pressure is indispensable for the ink jet recording unit. This leads to complexity of the construction.

SUMMARY OF THE INVENTION

Accordingly, an object of the present invention is to provide an ink jet recording unit which is simple in construction, can reliably seal an ink passage connecting a recording head to an ink tank, but allows the user to readily detach the ink tank from the recording head, and reduces air left in the jointing portion, to thereby provide a more perfect filling of ink and to improve the reliability of the ink jet recording unit.

The invention provides an ink jet recording unit having a recording head with an ink ejector that ejects ink, and an ink tank, detachably attached to the recording head, for supplying ink to the recording head, the ink jet recording unit being improved in that an elastic jointing member for jointing the ink tank and an ink passage to the recording head is provided on the recording head, the elastic jointing member including an umbrella-like portion having an opening formed at the top thereof and a space therein expanding downwardly.

Further, the invention provides an ink jet recording unit having a recording head with an ink ejector that ejects ink, and an ink tank, detachably attached to the recording head, for supplying ink to the recording head, the ink jet recording unit being improved such that an elastic jointing member for jointing the recording head to an ink passage of the ink tank is provided on the recording head, the elastic jointing member including an umbrella-like portion having an opening formed at the top thereof and a space therein expanding downwardly, and a flat part with an opening in the central part thereof, the umbrella-like portion and the flat part defining an angular space therebetween.

DETAILED DESCRIPTION OF PREFERRED EMBODIMENTS

Figure 1A:
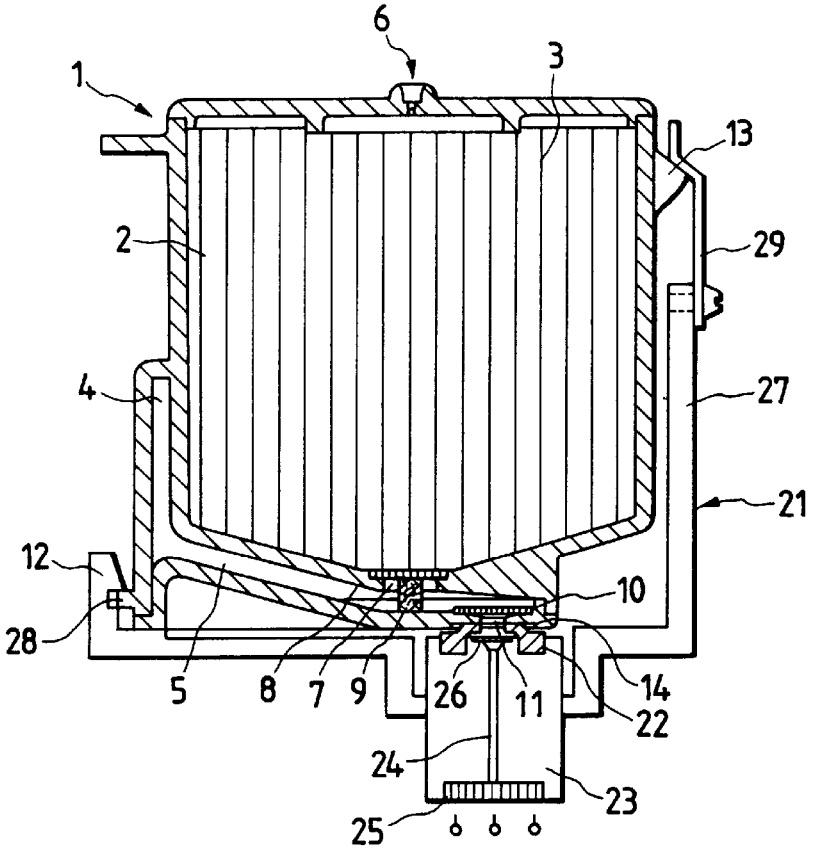
FIGS. 1A is a cross sectional view of an embodiment of an ink jet recording unit according to the present invention.
Figure 1B:
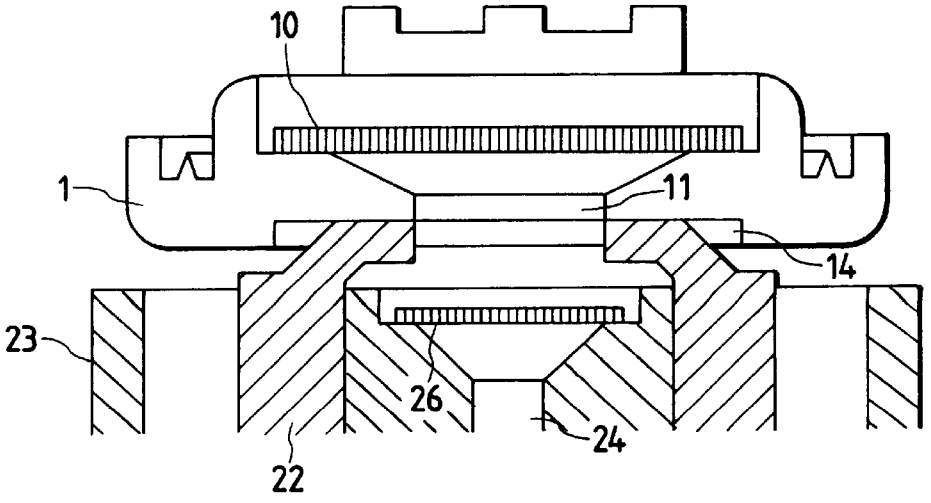
FIG. 1B is an enlarged elevation of a jointing portion and its near portion in the ink jet recording unit of FIG. 1A.

FIG. 1A is a cross sectional view showing an embodiment of an ink jet recording unit according to the present invention. FIG. 1B is an enlarged elevation of a jointing portion in the ink jet recording unit of FIG. 1A. In the figure, reference numeral 1 designates an ink tank; 2, an ink chamber; 3, a capillary member; 4, an intermediate chamber; 5, a communicating passage; 6, an air hole; 7, a communicating hole; 8, a first meniscus forming member; 9, an ink supply portion; 10, a second meniscus forming member; 11, a joint port; 12, an upright member; 13, a protrusion; 14, a depressed part; 21, a recording head; 22, an elastic jointing member; 23, a manifold; 24, an ink supply pipe; 25, a recording chip; 26, a filter; 27, a holding member; 28, a pawl; and 29, a spring member.

The ink jet recording unit is made up of the ink tank 1 and the recording head 21. The recording head 21 is fixed to a carriage of an ink jet recording apparatus. The ink tank 1 is removably attached to the recording head 21.

The recording head 21 is provided with the upright member 12 and the protrusion 13. The holding member 27, which partly forms the recording head 21, is provided with the pawl 28 and the spring member 29. The ink tank 1 is fastened to the recording head 21 in a manner that the pawl 28 is fit to the related part of the upright member 12 of the ink tank 1, and the spring member 29 is hooked to the protrusion 13. With an elasticity of the spring member 29, the ink tank 1 has some pressure acting on the recording head 21. To detach the ink tank 1 from the recording head 21, the protrusion 13 is disengaged from the spring member 29, and the pawl 28 is pulled out of the upright member 12.

The ink tank 1 contains the ink chamber 2 therein, and the intermediate chamber 4 formed along the outer side wall of the ink tank. The communicating hole 7 is formed in the bottom of the ink chamber 2. The ink chamber 2 communicates with the intermediate chamber 4 and the joint port 11, through the communicating hole 7. When the ink tank 1 is attached to the recording head 21, the ink chamber 2 is communicatively coupled with the recording head 21 at the joint port 11. In this state, ink flows from the ink chamber 2 to the recording head 21, through the communicating passage 5 and the joint port 11.

The bottom surface of the ink chamber 2 is downwardly slanted and deepest at the communicating hole 7. The communicating passage 5 is also deepest at the joint port 11, and is gradually and upwardly slanted to the intermediate chamber 4. The capillary member 3 is disposed in the ink chamber 2. The capillary member 3 holds ink by its capillary action, and maintains a negative pressure in the recording head 21. The air hole 6, which is continuous to the ink chamber 2 and the air, is formed in the upper part of the shell of the ink chamber 2. The upper part of the capillary member 3 opens to the air, through the air hole 6. In supplying ink to the recording head 21, ink is under pressure of the air in the upper part of the capillary member 3, while it is pulled down toward the communicating passage 5 by a negative pressure in the lower part thereof. Accordingly, ink in the capillary member 3 can efficiently be utilized. At this time, the capillary member 3 maintains a negative pressure in the recording head by its capillary action.

The first meniscus forming member 8 is disposed at the communicating hole 7 formed in the bottom part of the shell of the ink chamber 2. The bottom of the capillary member 3 is pressed against the first meniscus forming member 8. When the capillary member 3 is impregnated with ink, ink moves to the intermediate chamber 4 through the first meniscus forming member 8. The first meniscus forming member 8 prevents unwanted air from entering the intermediate chamber 4 even when ink is used up in the capillary member 3. When ink is consumed, air coming in through the air hole 6 passes through the capillary member 3. With increase of the negative pressure in the ink chamber 2, the air pushes the meniscuses of ink formed in the perforations of the first meniscus forming member 8 abutted on the capillary member 3, and overcomes the surface tension and breaks through the meniscuses, and becomes ink bubbles. The bubbles pass through the communicating passage 5 and reaches the intermediate chamber 4. The slope of the communicating passage 5 ensures a smooth movement of the bubbles to the intermediate chamber 4.

The ink supply portion 9 is in contact with the lower surface of the first meniscus forming member 8, and extends up to the bottom surface of the communicating passage 5. Alternatively, it may be formed as a part of the first meniscus forming member 8. The dimension of the cross section of the ink supply portion 9 is smaller than the diameter of the communicating hole 7. When bubbles stays on the lower surface of the first meniscus forming member 8, and an air layer is formed thereon, or when ink is used up in the ink chamber 2 and the liquid level of ink drops below the height of the communicating hole 7, the ink supply portion 9 sucks up ink from the bottom of the communicating passage 5 and supplies it to the first meniscus forming member 8. As a result, the first meniscus forming member 8 is kept wet and the negative pressure is maintained. In this way, an optimum state is kept in the ink jet recording unit till ink is used up.

In an initial stage, the intermediate chamber 4 is filled with ink. Bubbles are received by and accumulated in the intermediate chamber 4. Those bubbles were supplied from the ink chamber 2 and enter the communicating passage 5 after passing through the first meniscus forming member 8. The quantity of the accumulated bubbles increases in accordance with the amount of the used ink after ink is used up in the ink chamber 2. Accordingly, it is possible to detect whether or not ink is used up in the ink chamber.

The second meniscus forming member 10 is provided at the joint port 11. In a state that the ink tank 1 is detached from the ink tank 1, ink is not leaked out of the intermediate chamber 4 and the communicating passage 5, through the joint port 11 by the action of the surface tension of ink in the perforations of the second meniscus forming member 10. In setting the ink tank 1 to the recording apparatus, a pressure generated when it is set causes air left in the joint port 11 to pass through the ink film of the second meniscus forming member 10 and to move it to the intermediate chamber 4. The result is to lessen the bubbles to be moved to the recording head 21. In a state that the ink tank 1 is attached to the recording apparatus, it protects the ink tank 1 against vibration, impact and a pressure variation by acceleration, and prevents bubbles from entering the print head.

The depressed part 14 is provided around the joint port 11. When the ink tank 1 is attached to the recording head, the elastic jointing member 22 is brought into contact with the depressed part 14, to thereby form an ink passage. Accordingly, the depressed part 14 is wetted with ink in a state that the ink tank 1 is attached to the recording head. When the ink tank 1 is detached from the head, ink remains attached to the depressed part 14. If the detached ink tank 1 is put on the desk, ink does not pass through to the desk since the depressed part 14 is present. In other words, the desk is not soiled.

The recording head 21 is formed with the holding member 27 of the ink tank 1, and the manifold 23 provided with the elastic jointing member 22. The manifold 23 is integrally formed with the recording chip 25, the ink supply pipe 24 for supplying ink to the recording chip 25, the filter 26 for trapping dust, and the like. The holding member 27 is provided with the pawl 28 and the spring member 29. The pawl 28 is fit to the upright member 12 of the ink tank 1. The spring member 29 is hooked to the protrusion 13 of the ink tank 1, and presses the ink tank 1 by its elasticity. Particularly, a pressure by the spring member 29, preferable for the hermetical sealing, is approximately 200 gf, as empirically taught.

The elastic jointing member 22 is provided at the jointing portion of the recording head 21 where it is jointed to the ink tank 1. The protruded part of the manifold 23 is press fit to the elastic jointing member 22. With the press fitting, the manifold 23 is hermetically coupled with the elastic jointing member 22.

Figure 2A:
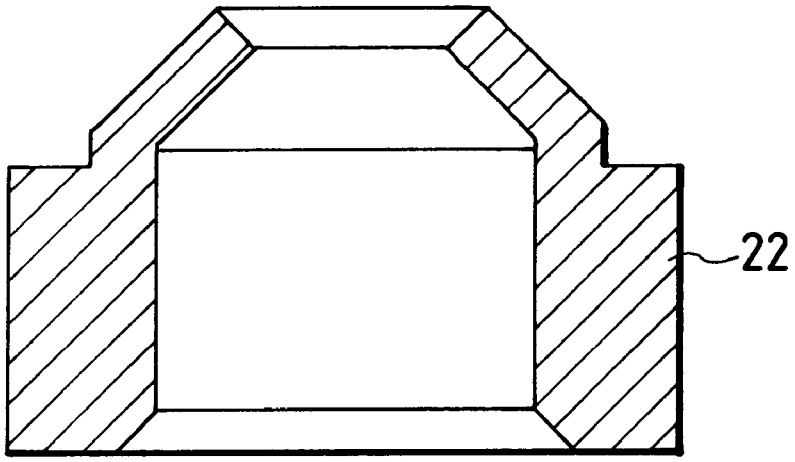
FIGS. 2A and 2B are cross sectional views of an elastic jointing member used in the ink jet recording unit.
Figure 2B:
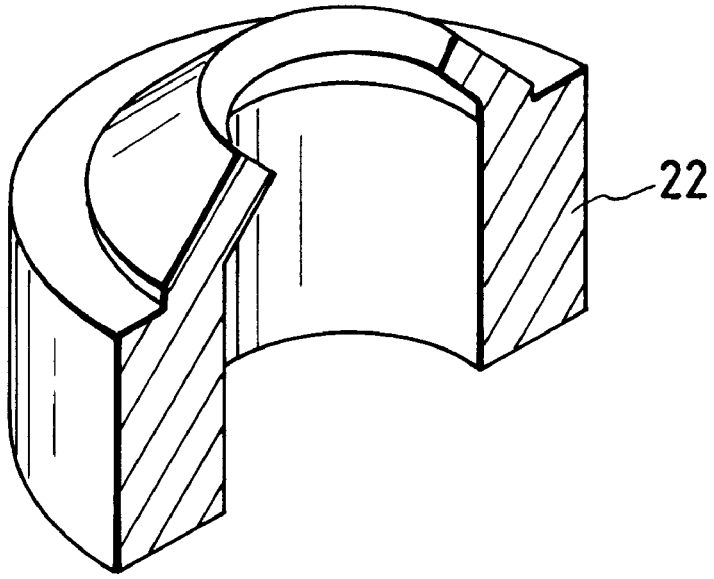

FIGS. 2A and 2B are cross sectional views showing an example of the elastic jointing member used in the embodiment of the ink jet recording unit according to the present invention. As shown, the elastic jointing member 22 is shaped like an umbrella with an opening at the top thereof. In other words, the umbrella-like portion is trapezoidal in cross section, with the shortest diameter of the opening formed at the top thereof. The umbrella-like portion is brought into contact with the face of the depressed part 14 of the ink tank 1, to thereby secure hermetic sealing thereat. When the top edge is brought into contact with the face of the depressed part 14 of the ink tank 1, and an ink passage is formed thereat, a contact area of the depressed part 14 where it contacts ink is small since the opening of the umbrella-like portion is small. Accordingly, when the ink tank 1 is detached from the recording head 21, a small amount of ink sticks to the depressed part 14, and no ink drips from the ink tank 1, although ink drips therefrom. The opening of the umbrella-like portion may be circular. It may be rectangular or elliptical or it may take any other suitable shape, as a matter of course.

A material of low air permeability and high surface smoothness is preferable for the elastic jointing member 22. If the surface smoothness of the elastic jointing member 22 is high, when the elastic jointing member 22 comes in contact with the depressed part 14 of the ink tank 1, it slides thereon. Accordingly, the elastic deformation of it goes well. Chlorinated butyle rubber, for example, is preferable for the elastic jointing member 22. In this case, approximately 60° degree is preferable for the rubber hardness in order to ensure a reliable hermetic sealing. Silicone rubber of 50° in rubber hardness or any of other suitable ink-resistance materials may be used for the elastic jointing member 22. The thickness of the umbrella-like portion 31 is preferably approximately 0.5 mm to provide an easy contact with the face of the ink tank 1.

When the depressed part 14 of the ink tank 1 is brought into contact with the elastic jointing member 22, the edge of the opening of the elastic jointing member 22 slides on the face of the depressed part 14 of the ink tank 1. The umbrella-like portion is elastically deformed inward to come in contact with the ink tank 1, and tightly contacts the ink tank 1 as shown in FIG. 1B, to thereby hermetically seal the ink passage. A small force suffices for the elastic deformation of the umbrella-like portion of the elastic jointing member 22. Accordingly, the hermetic sealing of the ink passage is realized even if the pushing force to the ink tank 1 and the recording head 21 is small. In a state that the ink tank 1 is attached to the recording head, an area of the ink tank 1 where it is wet with ink is small. Accordingly, a small amount of ink sticks to the ink tank 1 when the ink tank 1 is detached from the recording head 21, and no ink drips from the ink tank 1 when it is removed.

Figure 3A:
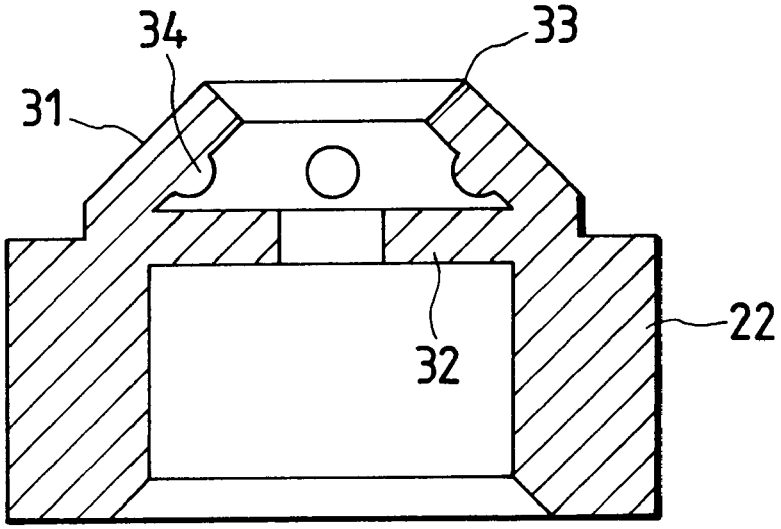
FIGS. 3A and 3B are cross sectional views of another elastic jointing member used in the ink jet recording unit.
Figure 3B:
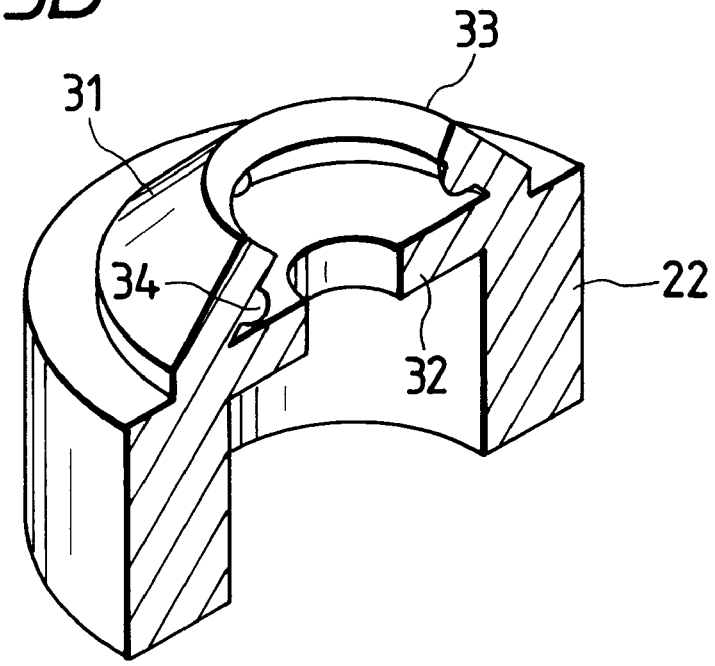

FIG. 3A and 3B are cross sectional views showing another example of the elastic jointing member used in the embodiment of the ink jet recording unit according to the present invention. In the figure, reference numeral 31 designates an umbrella-like portion; 32, a flat part; 33, a top edge shaped like a wedge in cross section; and 34, protrusions. The elastic jointing member 22 includes the umbrella-like portion 31 having an opening at the top thereof and a downwardly expanded space therein, and the elastic jointing member 22 having an opening in the central part thereof. The umbrella-like portion 31 is trapezoidal in cross section, with the shortest diameter of the opening formed at the top thereof. The top edge 33 of the opening of the umbrella-like portion 31 is brought into contact with the face of the depressed part 14 of the ink tank 1, to thereby secure hermetic sealing thereat. When the top edge 33 is brought into contact with the face of the depressed part 14 of the ink tank 1, and an ink passage is formed thereat, a contact area of the depressed part 14 where it contacts ink is small since the opening of the umbrella-like portion 31 is small. Accordingly, when the ink tank 1 is detached from the recording head 21, a small amount of ink sticks to the depressed part 14, and no ink drips from the ink tank 1. The opening of the umbrella-like portion 31 may be circular. It may be rectangular or elliptical or it may take any other suitable shape, as a matter of course.

The flat part 32 is shaped like a doughnut, and has an opening in the central part, which is to serve as an ink passage. The flat part 32 is inwardly extended from the bottom of the umbrella-like portion 31, to thereby form an angular (i.e., truncated cone-shaped) space between the inner side of the umbrella-like portion 31 and the upper side of the flat part 32. If the flat part 32 is not formed, when the ink tank 1 is put thereon, air often stays in the inner space of the umbrella-like portion 31. The presence of air thereat possibly leads to print defects. To avoid this, the flat part 32 is used.

When the depressed part 14 of the ink tank 1 is brought into contact with the elastic jointing member 22, the top edge 33 of the opening of the elastic jointing member 22 slides on the face of the depressed part 14 of the ink tank 1. The umbrella-like portion 31 is elastically deformed inward to come in contact with the ink tank 1, to thereby hermetically seal the ink passage. A small force suffices for the elastic deformation of the umbrella-like portion 31 of the elastic jointing member 22. Accordingly, the hermetic sealing of the ink passage is realized even if the pushing force to the ink tank 1 and the recording head 21 is small. In a state that the ink tank 1 is attached to the recording head, the umbrella-like portion 31 is in contact with the ink tank 1 while being inwardly deformed as shown in FIG. 2. Accordingly, an area of the ink tank 1 where it touches ink is small. Accordingly, a small amount of ink sticks to the ink tank 1 when the ink tank 1 is detached from the recording head 21. For this reason, no ink drips from the ink tank 1 when it is removed.

When the ink tank 1 is attached to the recording head, the umbrella-like portion 31 is in contact with the flat part 32, or the umbrella-like portion 31 is slightly separated from the flat part 32 after the former is brought into contact with the latter, as shown in FIG. 1B. Accordingly, any excessive space is not present within the umbrella-like portion 31, and air left in the umbrella-like portion 31 is expelled out of the umbrella-like portion 31. The problem of the improper ejection of ink caused by residual air is not invited, and a good picture quality is secured.

The ink tank 1 is attached to the recording head, and the umbrella-like portion 31 is brought into contact with the flat part 32. Then, the minute gaps are filled with ink. In this case, the umbrella-like portion 31 sometimes is glued to the flat part 32 by the capillary force of ink. If those are glued together, the umbrella-like portion 31 is not returned to its original state when the ink tank 1 is detached from the recording head or when the ink tank 1 is attached to the recording head and the umbrella-like portion 31 is pressed against the ink tank. In this state, the umbrella-like portion 31 has an insufficient elasticity, which is required when the umbrella-like portion 31 comes in contact with the ink tank 1. The contact of the umbrella-like portion 31 with the ink tank 1 is poor, thereby allowing an ink to leak therethrough. It is noted that in this instance, the protrusions 34 are formed on the umbrella-like portion 31 so as to prevent the umbrella-like portion 31 from being glued to the flat part 32, as shown in FIGS. 3A and 3B.

The protrusions 34 are elastically deformable. Because of this, it has additional useful effects. When the ink tank 1 is pressed against the elastic jointing member 22 in attaching the ink tank 1 to the recording head or detaching it from the head, the umbrella-like portion 31 and the flat part 32 are elastically deformed. At this time, the protrusions 34 are deformed. Accordingly, the attaching and the detaching operation of the ink tank 1 is smoothly performed. If a large force is applied when the ink tank 1 is attached to the recording head 21, it is buffered by the umbrella-like portion 31, the flat part 32 and the protrusions 34. As a result, an abrupt application of the large force to the recording head 21 is avoided. Accordingly, the recording head 21 is not displaced even if the large force is applied.

A material of low air permeability and high surface smoothness is preferable for the elastic jointing member 22. If the surface smoothness of the elastic jointing member 22 is high, when the elastic jointing member 22 comes in contact with the depressed part 14 of the ink tank 1, it slides thereon. Accordingly, the elastic deformation of it goes well. Chlorinated butyle rubber, for example, is preferable for the elastic jointing member 22. In this case, approximately 60° is preferable for the rubber hardness in order to ensure a reliable hermetic sealing. Silicone rubber of 50° in rubber hardness or any of other suitable ink-resistance materials may be used for the elastic jointing member 22. The thickness of the umbrella-like portion 31 is preferably approximately 0.5 mm to provide an easy contact with the face of the ink tank 1.

Figure 4A:
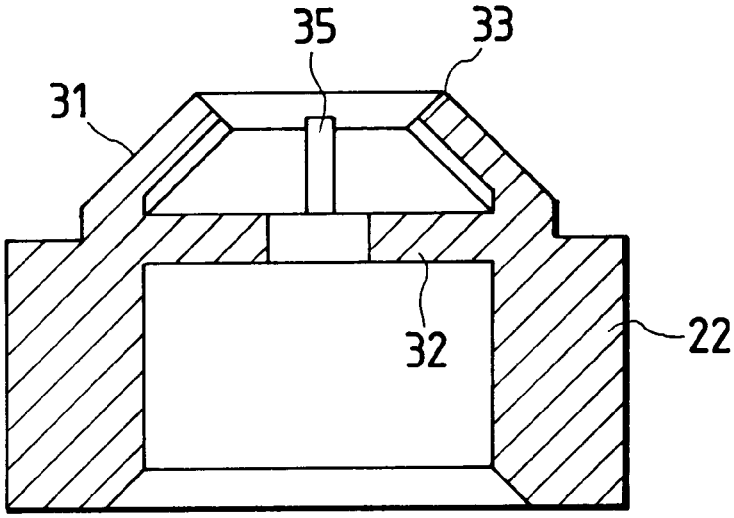
FIGS. 4A and 4B are cross sectional views of another elastic jointing member used in the ink jet recording unit.
Figure 4B:
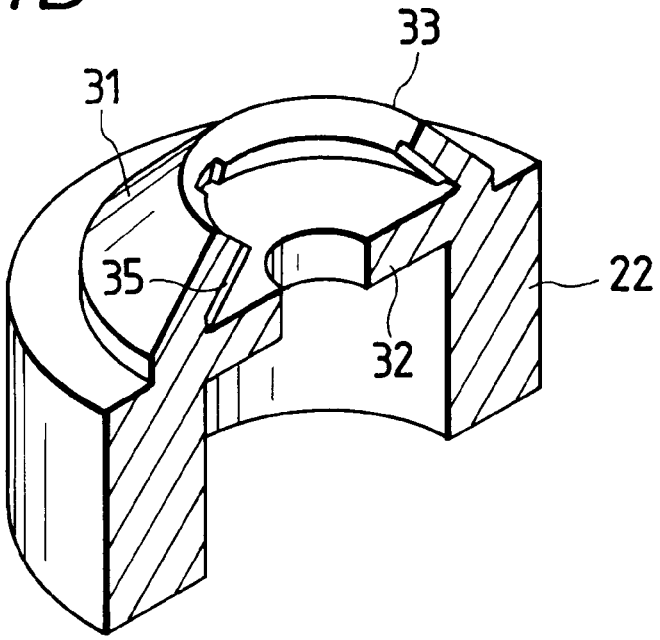

FIGS. 4A and 4B are cross sectional views showing another elastic jointing member that may be used for an ink jet recording unit of the present invention. In the figure, reference numeral 35 designates a groove. Thus, the ink guide means 35 shown in FIG. 4 may be used instead of the protrusions 34 in the instance of FIG. 3. The grooves 35 weakens the capillary force of ink going to between the umbrella-like portion 31 and the flat part 32. Accordingly, the umbrella-like portion 31 is easily separated from the flat part 32.

In the instance of FIG. 3 or 4, the protrusions 34 or the grooves 35 are provided on the umbrella-like portion 31. Alternatively, the provisions 34 or the grooves 35 may be formed on the portion of the flat part 32 to be in contact with the umbrella-like portion 31 as shown in FIGS. 8A and 8B and FIGS. 9A and 9B, respectively.

Figure 5A:
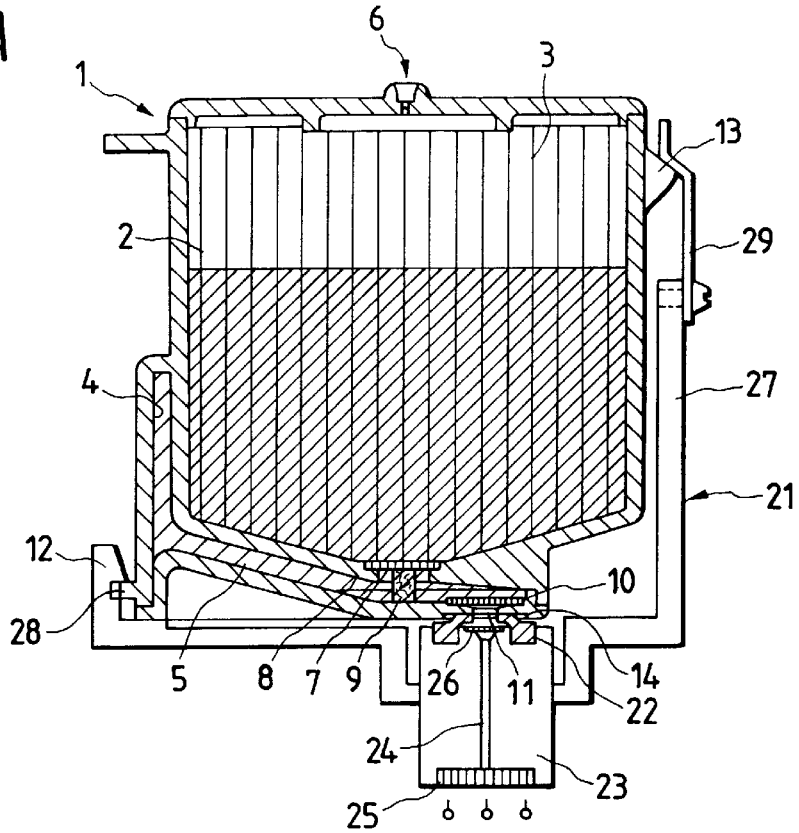
FIGS. 5A and 5B are explanatory diagrams for explaining states of the ink jet recording unit when ink is used.
Figure 5B:
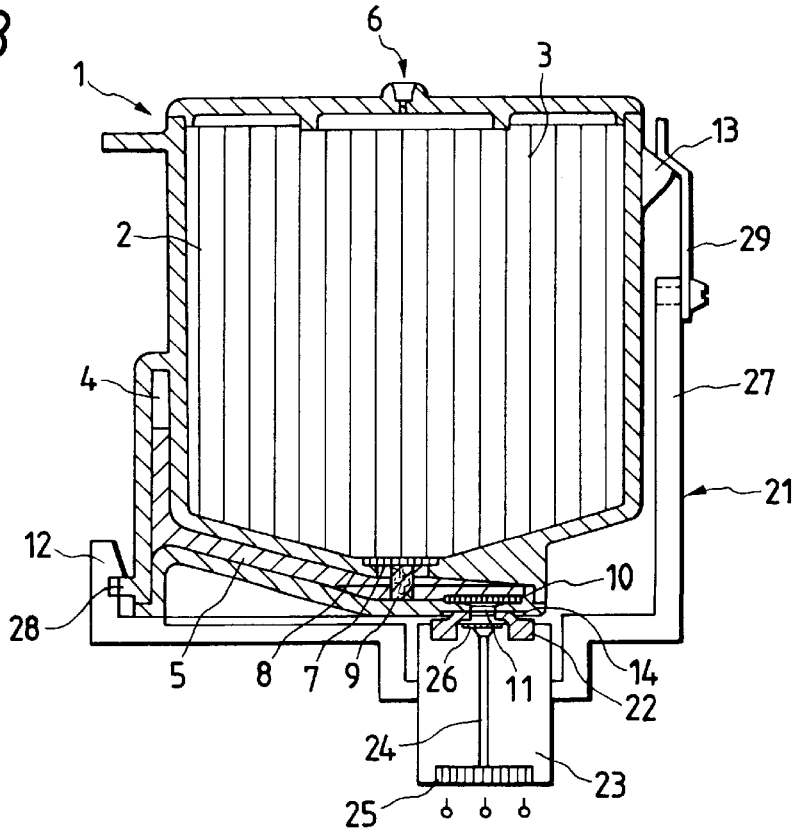

FIGS. 5A and 5B are explanatory diagrams for explaining states of the ink jet recording unit when ink is used. When the recording operation starts, ink is supplied from the ink chamber 2 to the recording head 21, through the communicating hole 7, the communicating passage 5, and the joint port 11. The ink supplied to the recording head 21 passes through a jointing portion between the ink tank 1 and the recording head 21. The jointing portion is hermetically sealed with the elastic jointing member 22, as mentioned above. Therefore, it is free from the ink leakage or air inflow. After passing through the jointing portion, the ink is supplied from the ink supply pipe 24 to the recording chip 25.

With the movement of ink, air gradually enters the ink chamber 2, from the air hole 6, and spreads into the capillary member 3. At this time, by the capillary action of the capillary member 3, the ink is supplied to the recording head 21 under a stable negative pressure. A state of the ink jet recording unit when ink is consumed to some extent is shown in FIG. 5A.

When the ink held by the capillary member 3 is consumed to a minimum level of the ink amount, air reaches the surface of the first meniscus forming member 8. And the ink is further consumed. Then, a fixed negative pressure (bubble point pressure of ink determined by a filtering accuracy of the first meniscus forming member 8) is applied to the first meniscus forming member 8. Under the negative pressure, air passes through the meniscuses of ink formed on the first meniscus forming member 8 to become bubbles. The bubbles thus generated move to the communicating passage 5. The bubbles further move to the intermediate chamber 4 along the slanted surface of the communicating passage 5, and accumulated in the intermediate chamber 4. The negative pressure in the communicating passage 5 is reduced by a quantity corresponding to the quantity of the bubbles moved to the intermediate chamber 4. As a result, the negative pressure in the recording head 21 is maintained. This state of the ink jet recording unit is shown in FIG. 5B. The sequence of the operations described above is repeated. The ink in the intermediate chamber 4 and the communicating passage 5 is continuously consumed till it is completely consumed.

In the state shown in FIG. 5B, both sides of the first meniscus forming member 8 are exposed to air. Also in the state shown in FIG. 5A, the surface of the first meniscus forming member 8 is infrequently covered with the entered bubbles. If it is covered with the bubbles, there is a chance that the meniscus of ink is not formed in the first meniscus forming member 8. Since the ink supply portion 9 is provided adjacent to the first meniscus forming member 8, ink is supplied to the first meniscus forming member 8 by the capillary action of the ink supply portion 9. Accordingly, the first meniscus forming member 8 is kept wet, the formation of the meniscus is possible, a stable negative pressure is maintained, and hence a good recording operation is secured.

In case where the ink tank 1 is removed in the state of FIG. 5A or 5B, the second meniscus forming member 10 of which the perforations are smaller in diameter than those of the first meniscus forming member 8, holds ink with the meniscuses formed therein. Accordingly, the negative pressure in the ink tank 1 is kept constant, and no ink leaks therefrom. The elastic jointing member 22 is shaped like an umbrella and elastically deformable inwardly, as recalled. Therefore, the amount of ink sticking to the depressed part 14 of the ink tank 1 is small, and no ink drips from the ink tank. It is noted that the contact of the elastic jointing member 22 with the ink tank 1 is made in the depressed part 14. With this, if the ink tank 1 is detached from the recording head and put on a desk, for example, the ink sticking to the depressed part 14 will not soil the desk. Accordingly, a user can detach the ink tank 1 from the recording head 21 without any special care.

Figure 6:
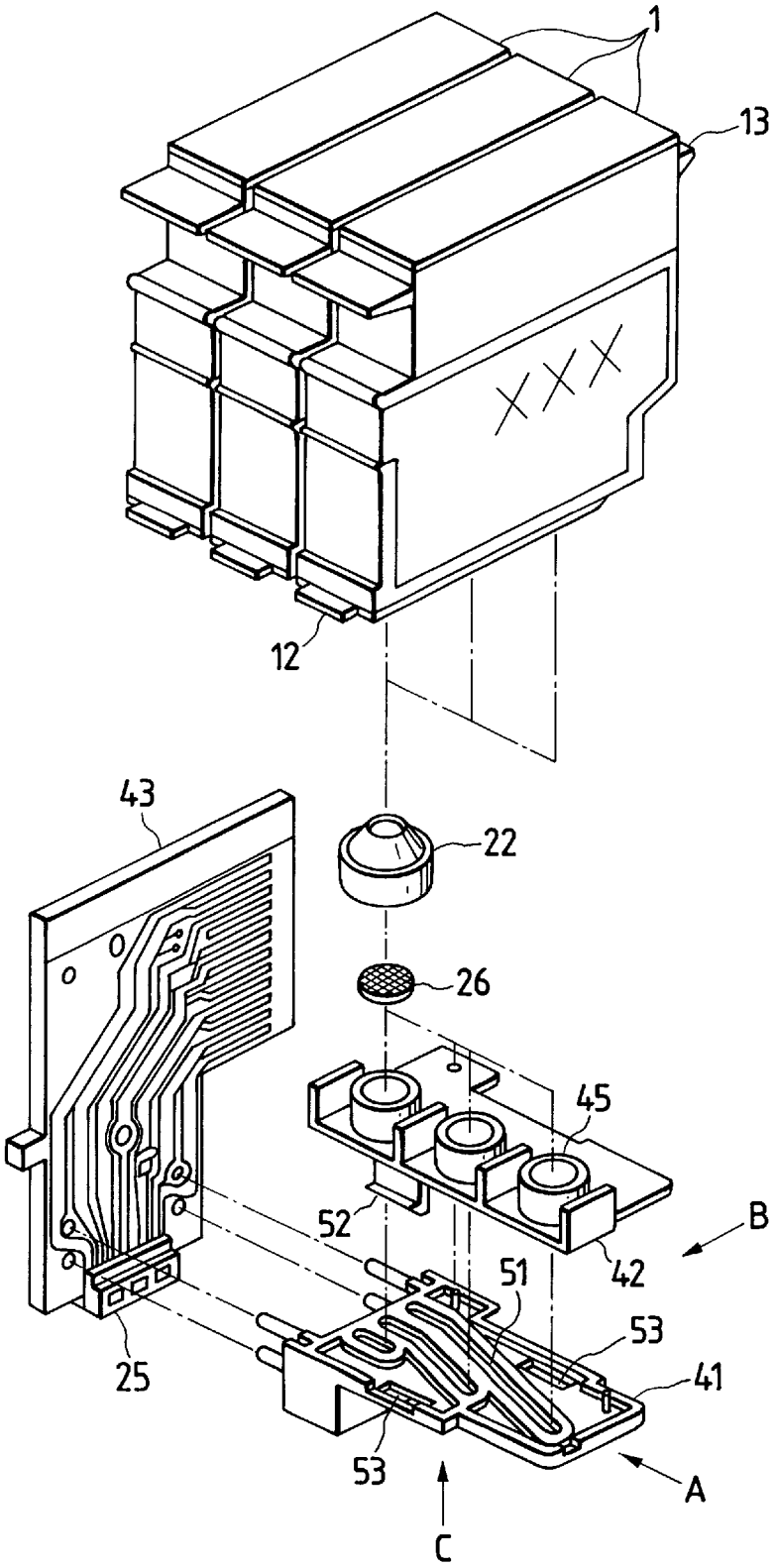
FIG. 6 is an exploded view in perspective of an overall construction of a specific ink jet recording unit according to the present invention.
Figure 7A:
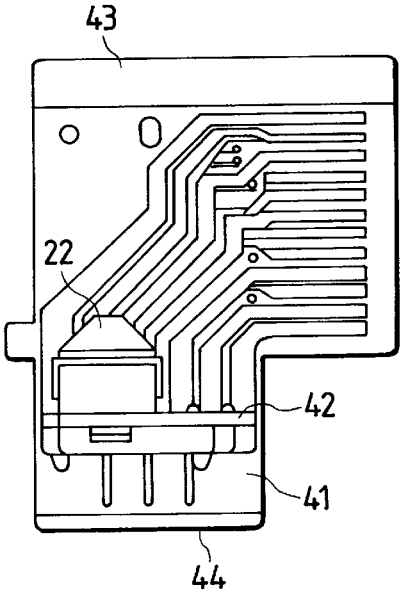
FIGS. 7A to 7C are three views showing a manifold portion in the ink jet recording unit of FIG. 5.
Figure 7B:
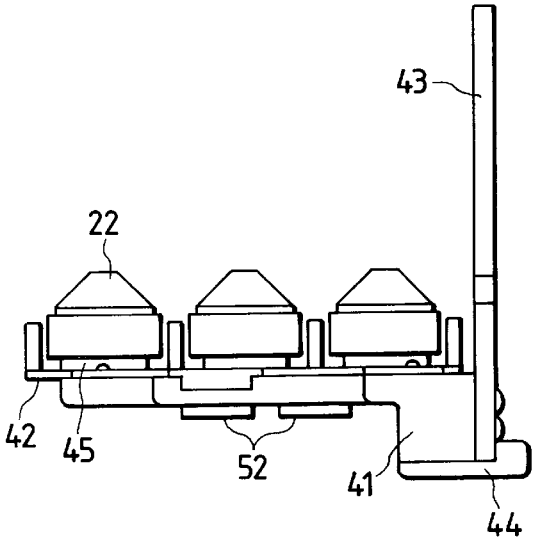
Figure 7C:
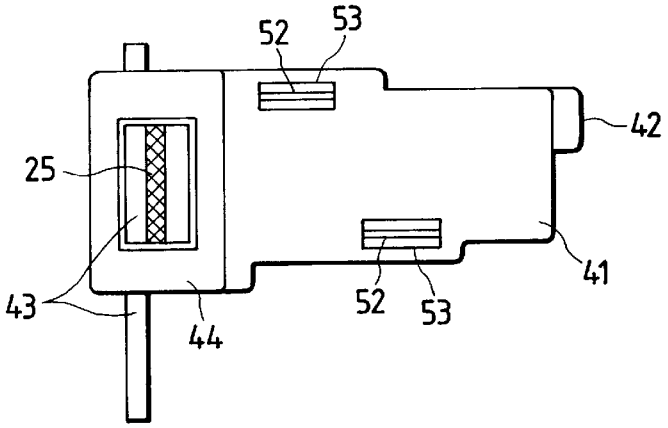
Figure 8A:
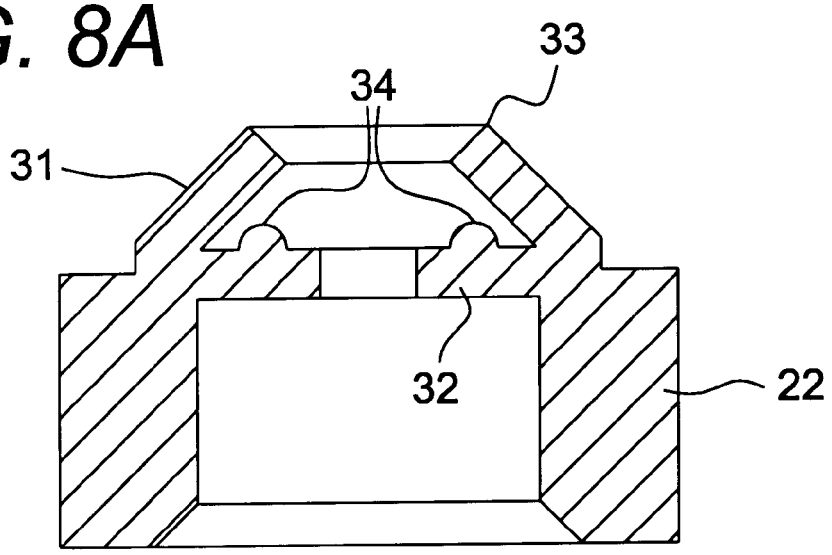
FIGS. 8A and 8B are cross sectional views of another elastic jointing member used in the ink recording unit.
Figure 8B:
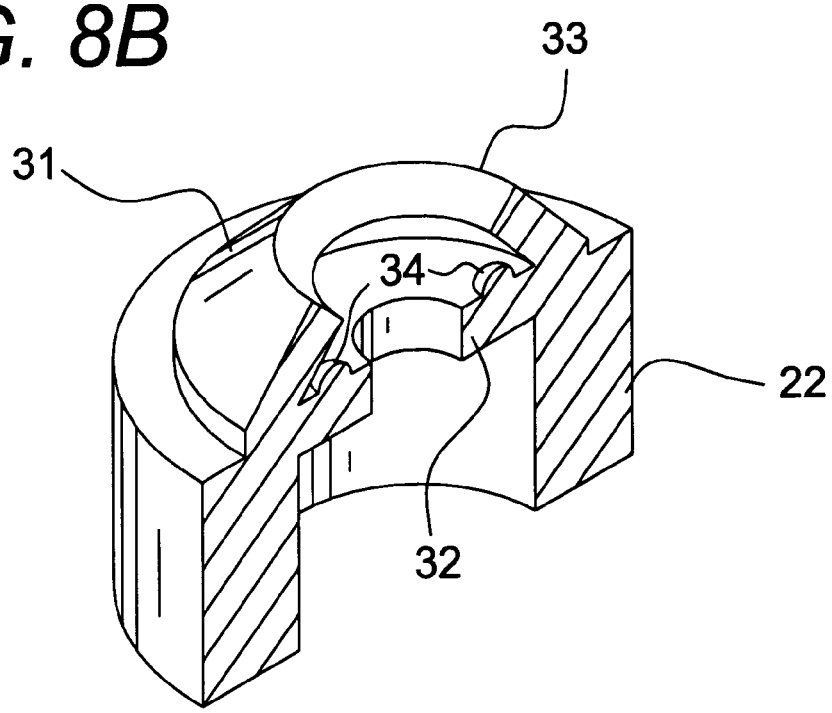
Figure 9A:
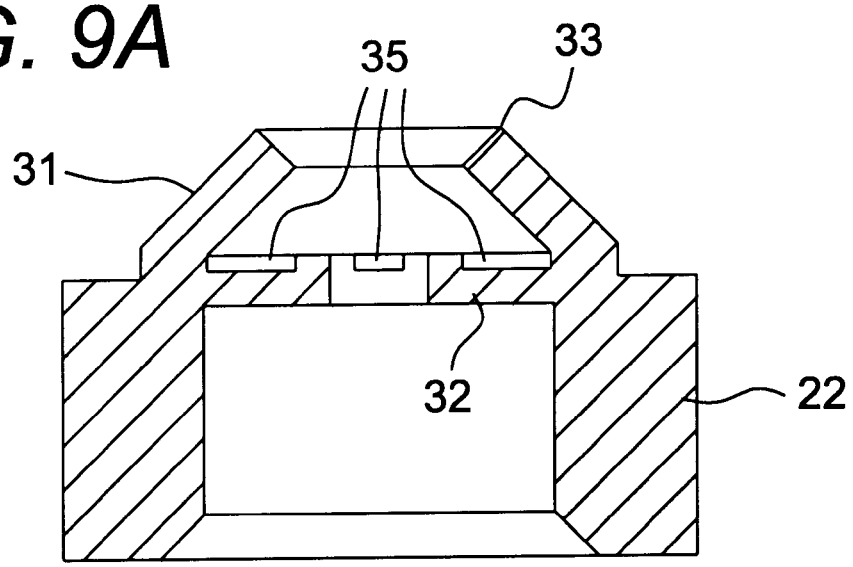
FIGS. 9A and 9B are cross sectional views of another elastic jointing member used in the ink recording unit.
Figure 9B:
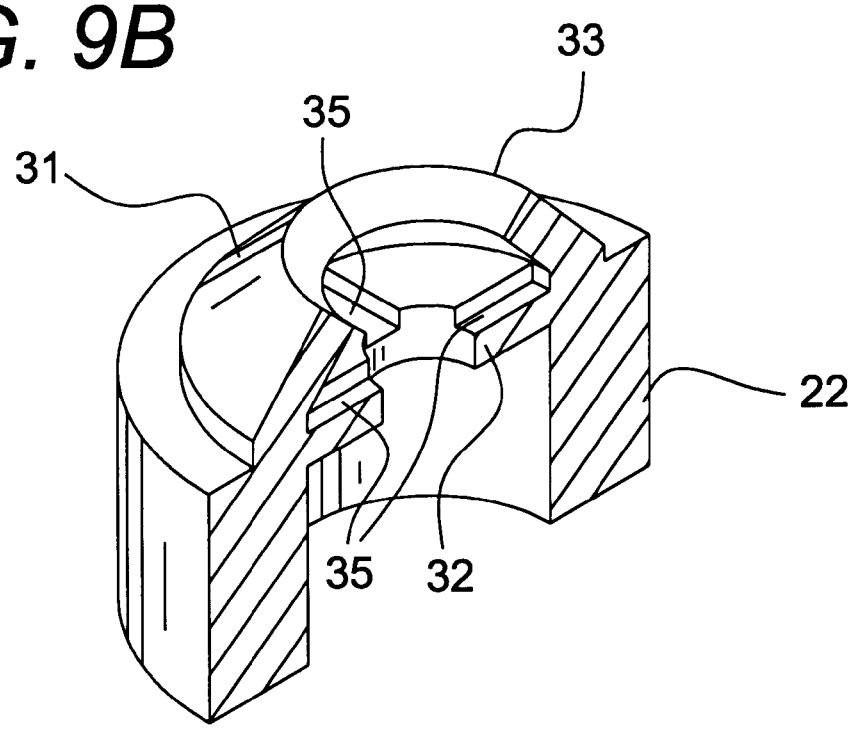

FIG. 6 is an exploded view in perspective of an overall construction of a specific ink jet recording unit according to another embodiment of the present invention. FIGS. 7A to 7C show three views of a manifold portion of the ink jet recording unit. FIGS. 7A, 7B and 7C show views of the manifold after assembled when viewed in the directions A, B and C in FIG. 6. In the figures, reference numeral 41 designates a manifold member; 42, a joint member; 43, a printed circuit board; 44, a front hat; 45, an ink guide means; 51, a groove; 52, a click-like part; and 53, a hole. The ink jet recording unit of the present embodiment is a color ink jet recording unit using a plural number of colors. In the instant ink jet recording unit, ink of three colors are used. In FIGS. 6 and 7, the holding member 27 is not shown.

The manifold member 41 with the joint member 42 bonded thereto is mounted on the printed circuit board 43. The recording chip 25 is mounted on the printed circuit board 43, and the front hat 44 is further mounted on the ink discharging surface. The ink tank 1 is detachably applied onto the joint member 42 from above the joint member, and ink is supplied from the ink tank 1 to the recording chip 25, through the manifold 23.

Three ink tanks contain ink of three different colors, respectively. These colors are cyan, magenta and yellow. Other colors than those may be used instead, as a matter of course. For example, four colors including black may be used. Two colors or five or larger number of colors may be used. In this case, the number of ink tanks used is equal to the number of the colors. Where ink of black is used, the amount of the ink is larger than that of each of the remaining ink. Accordingly, in this case, the ink passage for the black ink is larger that of each of the remaining ink. It is evident that the present invention may be applied to the recording device operating for the printing of only one color.

The joint member 42 is provided with three ink guide means 45, which are to be coupled with the ink tanks containing ink of different colors. The filter 26 and the elastic jointing member 22 are coupled with each of ink guide means 45. A protrusion of the ink guide means 45 is press fit into the elastic jointing member 22. In this way, the ink guide means 45 is hermetically coupled with the elastic jointing member 22, to thereby prevent the entrance or escape of air and ink leakage from taking place there. The elastic jointing member 22 is assembled in a state that the opening of the umbrella-like portion of the elastic jointing member 22 is directed upward.

When the three ink tanks 1 are applied to the joint member 42, the elastic jointing members 22 are pressed against the depressed parts of the joint portions of the ink tanks 1. At this time, the top edges 33 of the elastic jointing members 22 are brought into contact with the faces of the depressed parts of the ink tanks 1. The umbrella-like portions of the elastic jointing members 22 are elastically deformed inward. As a result, airtightly sealed ink passages are formed in the jointing portions, respectively.

Grooves 51 for forming ink supplying passages for respective color ink are formed in the manifold member 41. The joint member 42 is applied, from above, and bonded to the manifold member 41 with the grooves 51, so that ink supplying passages are formed. In the present embodiment, the joint member 42 is provided with the click-like part 52. When the joint member 42 is applied to the manifold member 41, the click-like part 52 is inserted into the hole 53 of the manifold member 41, to thereby enhance the coupling of them. During the hardening process of adhesive, the joint member 42 can easily be coupled with the manifold member 41 without any action from outside. The ink supplying passages thus formed receive ink from the ink guide means 45 through the filters 26, and supply them to the recording chip 25.

The printed circuit board 43 includes a circuit board having wires for supplying electric power, control signals, image signals to be recorded, and the like to the recording chip 25, and a metal board with a heat sink, integrally formed therein, for dissipating heat generated by the recording chip 25. Sometimes, the printed circuit board 43 includes a drive circuit for driving heating members in accordance with image signals to be recorded. The printed circuit board 43 are electrically connected to the recording chip 25 by wire bonding.

In the embodiment and the specific example, which are described above, the elastic jointing member 22 is provided on the recording head 21, but it may be provided on the ink tank 1. In this case, the jointing portion of the recording head 21 is designed to have a flat face surrounded by the raised peripheral edge. The jointing portion is hermetically sealed by pressing the elastic jointing member 22 against the flat face. Also in such a construction, the ink passage may be hermetically sealed. Further, the umbrella-like portion 31 is located close to the flat part 32, to thereby prevent air from staying in the umbrella-like portion. Furthermore, it is noted that the diameter of the elastic jointing member 22 is gradually reduced toward the opening. With this shape, the ink left in the elastic jointing member 22 is minimized. The amount of ink that may drip from the elastic jointing member 22 is also reduced to a minimum.

As seen from the foregoing description, the elastic jointing member with the umbrella-like portion made of elastic material is provided in a jointing portion where the ink tank is detachably attached to the recording head. With this structure, the jointing portion between the ink tank and the recording head is hermetically sealed by a simple operation, or by merely attaching the ink tank to the recording head. Therefore, no ink leakage and ink inflow do not take place in the jointing portion. The hermetic sealing by the elastic jointing member is stable. Accordingly, it does not have any adverse effect on the print quality, for example. Further, the hermetic sealing is realized using a small pressure. This implies that the attaching and the detaching operations of the ink tank are easy or a user can easily detach the ink tank from the recording head.

The portion of the elastic jointing member where it is in contact with the ink tank is shaped like an umbrella. In the jointing portion, an area where ink sticks to the ink tank is reduced. Accordingly, if the ink tank is detached during the use of the ink jet recording unit, no ink drips from the ink tank. Further, the depressed part is provided in the jointing portion where the elastic jointing member comes in contact with the ink tank. Accordingly, even if the ink tank is detached from the recording head during the use of the ink jet recording unit, and put on the desk, for example, the desk is not soiled with ink.

As seen from the foregoing description, the elastic jointing member with the umbrella-like portion made of elastic material and the flat part is provided in a jointing portion where the ink tank is detachably attached to the recording head. With this structure, the jointing portion between the ink tank and the recording head is hermetically sealed by a simple operation, or by merely attaching the ink tank to the recording head. Therefore, no ink leakage and ink inflow do not take place in the jointing portion. No air stays in the elastic jointing member. Accordingly, the problem of the improper ejection of ink caused by residual air is not invited, and a good picture quality is secured. With provision of the protrusions 34 or the grooves 35 between the umbrella-like portion 31 and the flat part 32, the umbrella-like portion 31 is not glued to the flat part 32. As a result, a stable hermetic coupling of the ink tank with the elastic jointing member is secured. Further, the hermetic sealing is realized using a small pressure. This implies that the attaching and the detaching operations of the ink tank are easy or a user can easily detach the ink tank from the recording head.

What is claimed is:

1. An ink jet recording unit comprising:

a recording head with an ink ejecting means for ejecting ink, the recording head having a recording head ink passage;

an ink tank, detachably attached to said recording head along a common axis, for supplying ink to said recording head, the ink tank having an ink tank ink passage, the ink tank ink passage and the recording head ink passage defining the common axis and having an ink tank ink passage direction and a recording head ink passage direction;

an elastic jointing member, provided on said recording head, for jointing said recording head ink passage and said ink tank ink passage, said elastic jointing member including an umbrella-like portion having an opening formed at a top thereof and a space therein, wherein the space expands in the recording head ink passage direction of the common axis and the jointing portion forms a jointing ink passage connecting the ink tank ink passage and the recording head ink passage.

2. The ink jet recording unit as claimed in claim 1, wherein said elastic jointing member is provided on said recording head, and a portion of said ink tank where said ink tank comes in contact with said elastic jointing member extends farther in the recording head direction of the common axis than a surrounding surface of said ink tank.

3. The ink jet recording unit as claimed in claim 1, wherein said elastic jointing member further includes a flat part with a flat part opening centrally positioned therein, said umbrella-like portion and said flat part defining a truncated cone-shaped space therebetween.

4. The ink jet recording unit as claimed in claim 3, in which a plural number of protrusions are formed on one of said umbrella-like portion and said flat part, which face each other.

5. The ink jet recording unit as claimed in claim 3, in which a plural number of grooves are formed on one of said umbrella-like portion and said flat part, which face each other.

6. The ink jet recording unit as claimed in claim 3, wherein the opening formed at the top of said umbrella-like portion has an edge disposed nearest the ink tank, and the edge is brought into contact with said ink tank.

* * * * *